US008833122B2

(12) United States Patent
Konchan et al.

(10) Patent No.: US 8,833,122 B2
(45) Date of Patent: Sep. 16, 2014

(54) KEY FOB TRANSPORT CLIP

(75) Inventors: Jeffrey L. Konchan, Romeo, MI (US); Jorg Gschweng, Mainz (DE); Grant W. Nelson, Macomb, MI (US); Kemal Altin, Bochum (DE); Frank Biallas, Velbert (DE); Jens Koenigsfeld, Dusseldorf (DE)

(73) Assignee: GM Global Technology Operations LLC, Detroit, MI (US)

( * ) Notice: Subject to any disclaimer, the term of this patent is extended or adjusted under 35 U.S.C. 154(b) by 73 days.

(21) Appl. No.: 13/570,308

(22) Filed: Aug. 9, 2012

(65) Prior Publication Data

US 2013/0219978 A1 Aug. 29, 2013

Related U.S. Application Data

(60) Provisional application No. 61/602,780, filed on Feb. 24, 2012.

(51) Int. Cl.
*A47G 29/10* (2006.01)

(52) U.S. Cl.
USPC ..... 70/456 R; 70/257; 70/396; 70/397; 70/399; 70/408; 70/459; 206/37.2; 206/38.1

(58) Field of Classification Search
CPC ..... E05B 19/04; E05B 19/00; E05B 19/24; E05B 19/043; E05B 19/18; A44B 15/002; A45C 11/324; A47G 29/10
USPC ..... 70/395–399, 414, 257, 456 R, 408, 70/457–460; 24/3.6; 206/38.1, 37.1–37.8
See application file for complete search history.

(56) References Cited

U.S. PATENT DOCUMENTS

| | | | | |
|---|---|---|---|---|
| 1,573,723 | A * | 2/1926 | Long | 70/456 R |
| 1,998,799 | A * | 4/1935 | Woina et al. | 70/456 R |
| 2,070,546 | A * | 2/1937 | Gits | 70/456 R |
| 2,924,961 | A | 2/1960 | Pyper | |
| 3,079,784 | A * | 3/1963 | Pavlowski | 70/456 R |
| 3,882,704 | A * | 5/1975 | Shanok et al. | 70/456 R |
| 4,688,410 | A * | 8/1987 | Jacobsen | 70/458 |
| 4,888,970 | A * | 12/1989 | Kinzler et al. | 70/456 R |
| 5,046,343 | A * | 9/1991 | Miwa | 70/408 |
| 5,365,760 | A * | 11/1994 | Song | 70/460 |
| 6,082,160 | A * | 7/2000 | Martyniak | 70/431 |
| 7,690,233 | B2 * | 4/2010 | Katagiri et al. | 70/456 R |
| 7,726,161 | B2 * | 6/2010 | Canard et al. | 70/456 R |
| 8,528,374 | B2 * | 9/2013 | Katagiri et al. | 70/456 R |
| 2001/0002544 | A1 * | 6/2001 | Schwab | 70/456 R |
| 2002/0100784 | A1 * | 8/2002 | Baird | 224/679 |
| 2005/0103070 | A1 * | 5/2005 | Meyerson et al. | 70/456 R |
| 2005/0204789 | A1 * | 9/2005 | Brion Camean et al. | 70/456 R |
| 2006/0016231 | A1 * | 1/2006 | Khounsombath et al. | 70/456 R |

(Continued)

*Primary Examiner* — Lloyd Gall
(74) *Attorney, Agent, or Firm* — Quinn Law Group, PLLC

(57) ABSTRACT

A transport clip for attachment to a key fob is provided. The transport clip includes a neck at least partially surrounding a key blade, which is selectively rotatable between a stowed position in which the key blade is substantially within a fob body and a deployed position in which the key blade extends away from the fob body. The neck prevents rotation of the transport clip relative to the key blade. The transport clip also includes an ear portion that depresses a latch button to an unlocked position, which allows substantially free rotation of the key blade, relative to the fob body, between the deployed position and the stowed position.

14 Claims, 3 Drawing Sheets

(56) References Cited

U.S. PATENT DOCUMENTS

2007/0220936 A1* 9/2007 Miyata et al. ..... 70/408
2009/0217722 A1* 9/2009 Luo et al. ..... 70/459
2010/0126242 A1 5/2010 Perlmutter et al.
2012/0272698 A1* 11/2012 Gschweng ..... 70/396
2012/0285208 A1* 11/2012 Delande et al. ..... 70/399

* cited by examiner

KEY FOB TRANSPORT CLIP

CROSS-REFERENCE TO RELATED APPLICATIONS

This application claims the benefit of U.S. Provisional Patent Application No. 61/602,780, filed on Feb. 24, 2012, the disclosure of which is hereby incorporated by reference.

TECHNICAL FIELD

This disclosure relates to keys and key fobs for vehicles.

BACKGROUND

Automobiles and other vehicles may use one or more keys to open or unlock doors. The keys may also be used to start the automobile or disarm security features.

SUMMARY

A transport clip for attachment to a key fob is provided. The key fob includes a fob body and a key blade, which is selectively rotatable between a stowed position in which the key blade is substantially within the fob body and a deployed position in which the key blade extends away from the fob body.

The transport clip includes a neck at least partially surrounding the key blade. The neck prevents rotation of the transport clip relative to the key blade. The transport clip also includes an ear portion that depresses a latch button of the key fob to an unlocked position. The unlocked position of the latch button allows substantially free rotation, relative to the fob body, of the key blade between the deployed position and the stowed position.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1B:
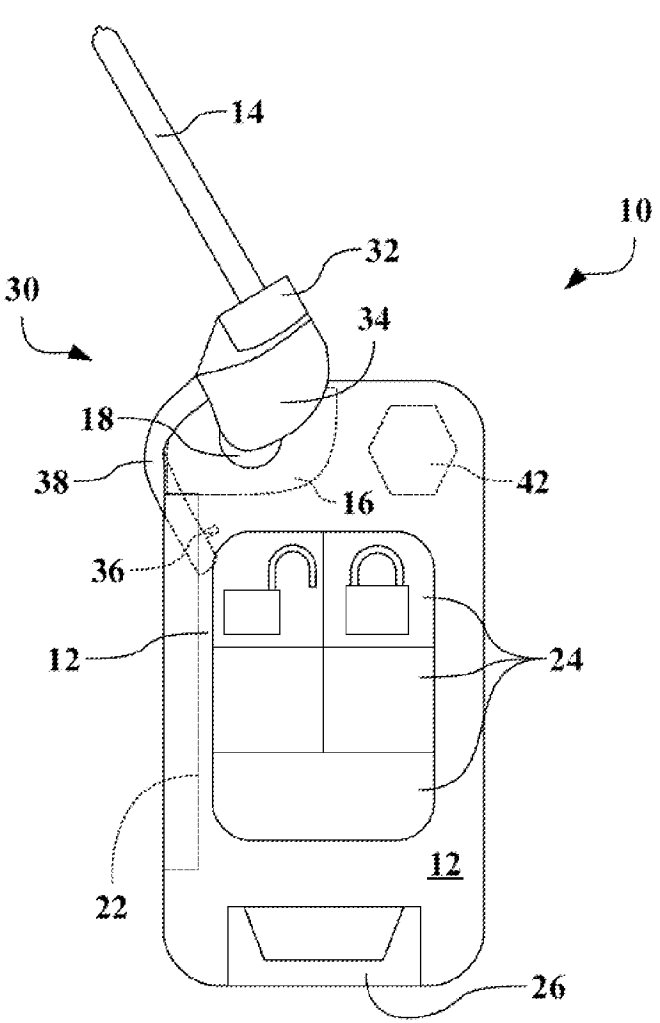
FIG. 1B is a schematic, plan view of the key fob and transport clip rotated toward a closed or stowed position.
Figure 1A:
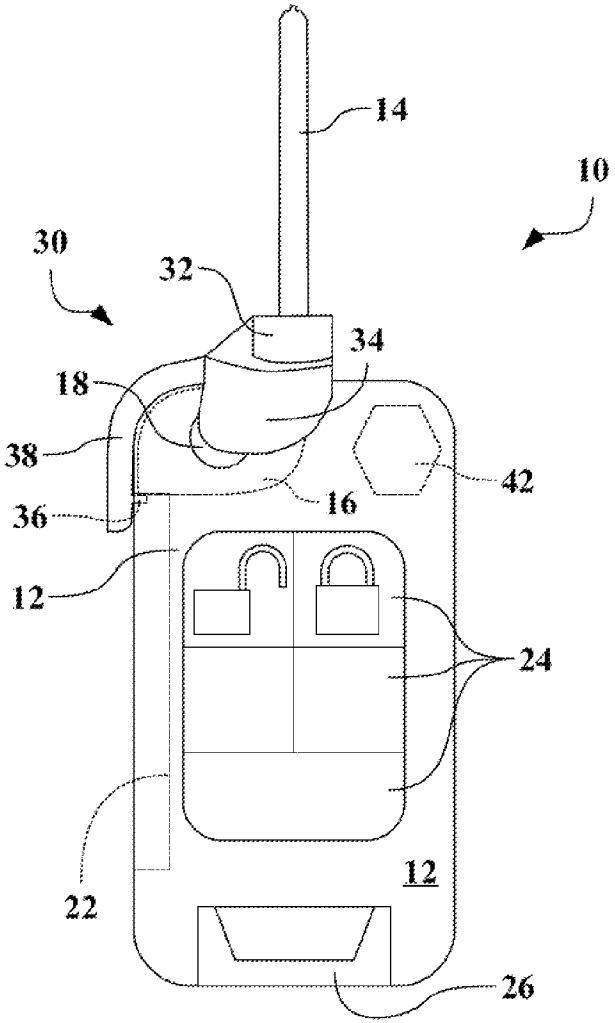
FIG. 1A is a schematic, plan view of a key fob in an open or deployed position having a transport clip attached.

Referring to the drawings, wherein like reference numbers correspond to like or similar components wherever possible throughout the several figures, there are shown in FIG. 1A and FIG. 1B two views of a key fob 10. Features and components shown in other figures may be incorporated and used with those shown in FIGS. 1A and 1B, and all elements may be mixed and matched between any of the configurations shown.

While the present invention is described in detail with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims.

The key fob 10 shown in FIGS. 1A and 1B may be used to unlock or open doors (not shown) of a vehicle (not shown) with which the key fob 10 is paired. Furthermore, the key fob 10 may interact with the vehicle ignition to start and operate the vehicle.

The key fob 10 includes a fob body 12 and a key blade 14, which is inserted into the ignition or door locks. The key fob 10 may be used to perform many additional functions related to the vehicle or other structures (such as garage door openers). The key blade 14 is a mechanical key, and the key fob 10 includes components that may be referred to as a keyless entry system.

A lockable bearing 16 is disposed within the fob body 12 and attaches the key blade 14 to the fob body 12. The lockable bearing 16 selectively allows rotation between an open or deployed position (shown in FIG. 1A) in which the key blade 14 extends away from the fob body 12, and a closed or stowed position in which the key blade 14 is substantially within the fob body 12. The key fob 10 and key blade 14 are shown in FIG. 1B in an intermediate position, in which the key blade 14 has been rotated counterclockwise toward the stowed position.

In the configuration shown, the key blade 14 rotates approximately 180 degrees from the stowed position to the deployed position, so that the key blade 14 extends upward (as viewed in FIGS. 1A and 1B). However, the key fob 10 may be configured such that the key blade 14 has more or less rotation and extends to either side (as viewed in FIGS. 1A and 1B). Additionally, the key blade 14 may rotate in either direction between the deployed position and the stowed position. In the configuration shown in FIGS. 1A and 1B, the key blade 14 rotates counterclockwise, relative to the front-facing portion of the fob body 12.

A latch button 18, which is partially hidden from view in FIGS. 1A and 1B, selectively restrains or allows rotation of the key blade 14. A locked position of the latch button 18 prevents rotation of the key blade 14. The locked position at least prevents rotation when the key blade 14 is in the stowed position and the deployed position. The locked position may also prevent rotation in intermediate positions, such that the key blade 14 locks at any degree of rotation between stowed and deployed. An unlocked position of the latch button 18 allows substantially free rotation of the key blade 14 between the deployed position and the stowed position.

When the key fob 10 is in the stowed position, the key blade 14 may be located within a nesting area 22 defined in the fob body 12. The key fob 10 may include one or more buttons 24, which may remotely control numerous functions, including: keyless entry, trunk or door actuation, or remote engine starts. Instead of, or in addition to, the buttons 24, the key fob 10 may incorporate components of a hands-free keyless system, which allows the vehicle to recognize that the key fob 10 is in proximity and may unlock doors or enable the ignition in response thereto.

The face of the fob body 12 having the buttons 24 may be referred to as the front of the key fob 10. The key fob 10 shown in FIGS. 1A and 1B also includes an attachment point 26, which may facilitate attachment of the key fob 10 to key rings, clips, or lanyards.

As shown in both FIG. 1A and FIG. 1B, a transport clip 30 is attached or mated to the key fob 10. The transport clip 30 includes a neck 32, which at least partially surrounds the key blade 14.

The neck 32 prevents rotation of the transport clip 30 relative to the key blade 14. Therefore, as the key blade 14 rotates from the deployed position shown in FIG. 1A to the intermediate position shown in FIG. 1B, the transport clip 30 also rotates. Note that the position shown in FIG. 1B is illustrative only and that portions of the transport clip 30 may bend or flex if the key blade 14 is rotated to the extent shown. The transport clip 30 may prevent rotation of the key blade 14 all the way to the stowed position by coming into contact with some portion of the nesting area 22 or other portions of the fob body 12.

In the configuration shown, the neck 32 completely surrounds the key blade 14. This may facilitate mating of the transport clip 30 to the key fob 10, such as at a manufacturing or assembly plant. The transport clip 30 may be attached by, for example, the supplier of the key fob 10, and the transport clip 30 may be assembled to the key fob 10 by sliding the neck 32 over the key blade 14 while the key blade 14 is in the deployed position or an intermediate position.

The transport clip 30 includes an ear portion 34, which extends or cantilevers over the latch button 18 of the key fob 10. The ear portion 34 is configured to move, push, or depress the latch button 18 of the key fob 10 to force the latch button 18 into the unlocked position.

In the configuration of the key fob 10 shown, the latch button 18 is biased into the locked position, in which the latch button 18 is pushed outward from the fob body 12 (toward the view point of FIGS. 1A and 1B). The unlocked position of the latch button 18 occurs as the latch button 18 is pushed or depressed into the fob body 12 (away from the view point of FIGS. 1A and 1B).

The locked position may lock the key blade 14 in intermediary positions, or may only restrict movement when the key blade 14 is in the stowed position or the deployed position. By depressing the latch button 18 to the unlocked position, the ear portion 34 of the transport clip 30 maintains the latch button 18 in the unlocked position, such that the key blade 14 is free to rotate without restriction from the locking bearing 16 or the latch button 18. Note that the ear portion 34 depresses the latch button 18 regardless of whether the key blade 14 is in the deployed position, the stowed position, or intermediary positions.

The key blade 14 may be biased toward the deployed position—for example, by a spring—such that the key blade 14 tends to open when the latch button 18 is depressed. Therefore, by depressing the latch button 18 and allowing the key blade 14 to freely rotate, the ear portion 34 of the transport clip 30 tends to cause the key blade 14 to move to the deployed position.

By keeping the key blade 14 in the deployed position, the transport clip 30 may facilitate processes occurring during vehicle assembly and manufacture. Additionally, by depressing the latch button 18, the ear portion 34 allows the key blade 14 to rotate relative to the fob body 12 if the fob body 12 is impacted or otherwise subjected to torque. If the latch button 18 is not depressed and the fob body 12 receives an impact or load, the key blade 14 may be bent or the lockable bearing 16 may be damaged.

The transport clip 30 shown in FIGS. 1A and 1B also includes a snap feature 36, which is configured to attach the transport clip 30 to the lockable bearing 16. However, the transport clip 30 may be mated or attached to other portions of the key fob 10, or may rely on the neck 32 to hold the transport clip 30 to the key blade 14 and allow the ear portion 34 to depress the latch button 18. As shown, the snap feature 36 may be connected to the neck 32 by an arm 38. The snap feature 36, the arm 38, or both may prevent the key blade 14 from rotating completely to the stowed position by contacting portions of the fob body 12.

As shown in FIGS. 1A and 1B, the transport clip 30 is formed from a single material as a unitary body having one-piece construction. Therefore, the neck 32, the ear portion 34, the snap feature 36, and the arm 38 are formed as one piece, which allows the transport clip 30 to be installed or mated to the key fob 10 as a single unit.

The transport clip 30 may be formed from plastic as the single material, or may be formed from alternative suitable materials. For example, the transport clip 30, including all of the elements and features shown in FIGS. 1A and 1B, may be formed by injection molding. Furthermore, the transport clip 30 shown may be formed through a single-shot molding process.

Some versions of the key fob 10 may include a transceiver module 42 disposed within the fob body 12. The transceiver module 42 may include a receiver, a transponder, or any combination thereof. The transceiver module 42 may operate on radio, wireless internet, cellular, RFID, or any other communication protocol.

Figure 2:
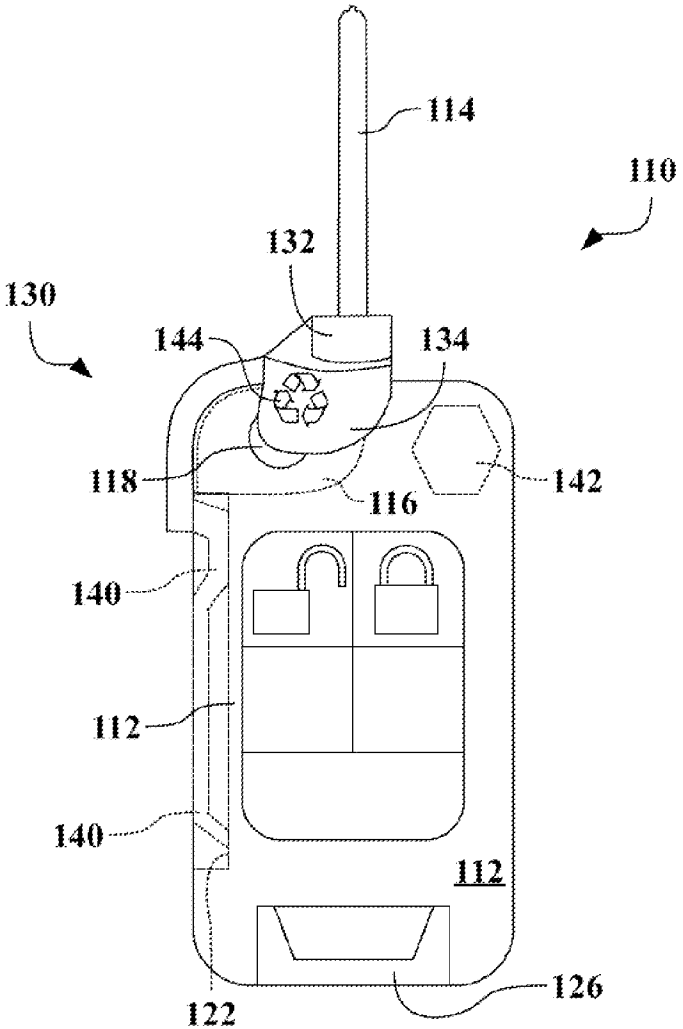
FIG. 2 is a schematic, plan view of a key fob having another transport clip attached thereto.

Referring now to FIG. 2, and with continued reference to FIGS. 1A and 1B, there is shown another key fob 110, which may be very similar to the key fob 10 and includes many of the same or similar features. While not all of the features of the key fob 110 are individually numbered in FIG. 2, the description of FIGS. 1A and 1B may be used to supplement the description of FIG. 2 and to identify unnumbered items. Features and components shown in other figures may be incorporated and used with those shown in FIG. 2, and all elements may be mixed and matched between any of the configurations shown.

The key fob 110 includes a fob body 112 and a key blade 114, and a transport clip 130 is attached to the key fob 110. The key blade 114 is selectively deployed from a stowed position (not shown) to a deployed position (shown in FIG. 2) by actuating a lockable bearing 116. Actuation of the lockable bearing 116 occurs by depressing a latch button 118. The key fob 110 shown in FIG. 2 also includes an attachment point 126, which may facilitate attachment of the key fob 110 to key rings, clips, or lanyards.

The transport clip 130 includes a neck 132, which at least partially surrounds the key blade 114. The neck 132 prevents rotation of the transport clip 130 relative to the key blade 114.

The transport clip 130 also includes an ear portion 134, which extends or cantilevers over the latch button 118 of the key fob 110. The ear portion 134 moves, pushes, or depresses the latch button 118 of the key fob 110. Therefore, the latch button 118 is held in an unlocked position by the ear portion 134, such that the latch button 118 does not prevent rotation of the key blade 114.

The transport clip 30 shown in FIGS. 1A and 1B is configured to rotate with the key blade 14, such that the key blade 14 is only kept in the deployed position by the lockable bearing 16 and the bias spring. However, the transport clip 130 is configured to restrict or prevent rotation of the key blade 114, such that the transport clip 130 keeps the key blade 114 in the deployed position under most, but not all, conditions.

A breakable tab 140 is formed on the transport clip 130 and is part of the unitary, one-piece construction with the neck 132 and the ear portion 134. The transport clip 130 may be mated to the key fob 110 by sliding the neck 132 over the key blade 114 while in the deployed position.

The breakable tab 140 engages with some portion of the fob body 112, and prevents relative rotation between the transport clip 130 and the fob body 112. The breakable tab 140 shown in FIG. 2 extends or cantilevers into a nesting area 122. Therefore, the breakable tab 140 limits rotation of the key blade 114 relative to the fob body 112 and provides reaction torque to maintain the key blade 114 in the fully-deployed position. For example, if the key fob 110 and the key blade 114 are engaged with the ignition switch—such as in the steering column or on the dash of the vehicle—and the fob body 112 is bumped, the breakable tab 140 may prevent the fob body 112 from rotating relative to the key blade 114.

Some versions of the key fob 110 may include a transceiver module 142 disposed within the fob body 112. The transceiver module 142 may include a receiver, a transponder, or any combination thereof. The transceiver module 142 may operate on radio, wireless internet, cellular, RFID, or any other communication protocol. In some configurations of the key fob 110, the transceiver module 142 may need to be kept in close proximity to the ignition switch, the steering column, or the door lock mechanism for some operations to take place. Therefore, the breakable tab 140 limits the likelihood of rotating the fob body 112 and moving the transceiver module 142 away from the ignition switch while the key blade 114 is engaged therewith.

In the transport clip 130 shown, the locked position of the latch button 118 prevents rotation of the key blade 114 when the key blade 114 is in the stowed position and when the key blade 114 is in the deployed position. The locked position of the latch button 118 subjects the key blade 114—such as by locking the lockable bearing 116—to a first torque relative to the fob body 112. Therefore, if the fob body 112 receives a heavy load, the key blade 114 may be subjected to the first torque, which may be sufficient to bend or otherwise deform the key blade 114.

With the key fob 10 shown in FIGS. 1A and 1B, the key blade 14 would be free to rotate toward the stowed position—or, depending upon the reference point, the fob body 12 would be free to rotate—when subjected to torque. However, the transport clip 130 includes the breakable tab 140, which limits rotation of the key blade 114 relative to the fob body 112. If the breakable tab 140 were capable of subjecting the key blade 114 to the same amount of reaction torque as the lockable bearing 116—i.e., the first torque—then the effect of the breakable tab 140 would be similar to not depressing the latch button 118 into the unlocked position.

However, the breakable tab 140 is configured to yield and allow rotation of the key blade 114 away from the deployed position when the key blade 114 is subjected to a second torque relative to the fob body 112. The breakable tab 140 actually generates a force at its point of contact with the fob body 112, but that force results in a reaction torque about the lockable bearing 116.

The breakable tab 140 is configured such that the second torque is less than the first torque. Therefore, the breakable tab 140 will yield and allow the fob body 112 to rotate at lower torque levels than the lockable bearing 116. The key blade 114 is less likely to be deformed under high loads imparted to the fob body 112 while the key blade is engaged with the ignition switch or door locks.

For example, and without limitation, the first torque may be in the range of 80-120 Newtons. Therefore, the lockable bearing 116 subjects the key blade 114 to reaction torque of between 80-120 Newtons. However, the key blade 114 may be bent or damaged under loads of, for example, greater than 50 Newtons. The second torque provided by the breakable tab 140 may be, for example, in the range of 30-40 Newtons. Note that because force applied at a distance results in torque, the two terms may be used interchangeably herein, such that any recitation of force applied or reacted may be converted into torque and vice versa.

Therefore, the transport clip 130 may be configured such that the breakable tab 140 only holds the key blade 114 with approximately 25-50% of the relative reaction torque between the key blade 114 to the fob body 112. The transport clip 130 holds the key blade 114 in the deployed position, but does so with lower reaction torque than the lockable bearing 116 and is less likely to damage the key fob 110.

The breakable tab 140 may alternatively be referred to as, for example and without limitation: a yielding tab, a breakable arm, or a sacrificial tab. Note that the breakable tab 140 need not actually break or fracture. The breakable tab 140 may be configured to yield by plastic deformation when subjected to the second torque. Furthermore, specific yielding points or regions may be formed into the breakable tab 140 to more-precisely control how the transport clip 130 yields when subjected to torque at or above the second torque. Alternatively, the mechanism or structure that holds the breakable tab 140 to the fob body 112 may be configured to lose grip or hold on the fob body 112 when the key blade 114 is subjected to a force resulting in at least the second torque relative to the fob body 112.

As shown in FIG. 2, the transport clip 130 also includes a molded icon 144. In this configuration, the molded icon 144 is formed between on the ear portion 134 adjacent to the neck 132. The molded icon 144 may be formed during molding of the whole, unitary transport clip 130 and may be used to communicate some feature or aspect of the transport clip 130.

The molded icon 144 may indicate removability of the transport clip 130 from the key fob 110. Alternatively, or additionally, the molded icon 144 may indicate recyclability of the transport clip 130. In many configurations of the key fob 110 and the transport clip 130, an end-user—such as a purchaser of the vehicle or a retailer of the vehicle—will remove the transport clip 130 from the key fob 110 following completion of assembly and transportation of the key fob 110 and the vehicle.

Figure 3:
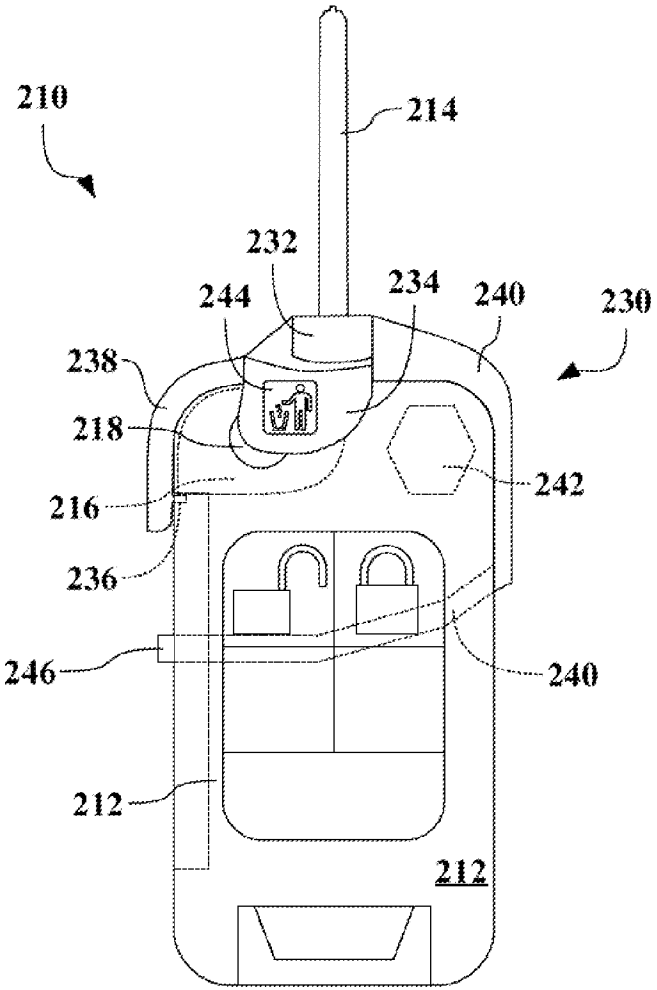
FIG. 3 is a schematic, plan view of another key fob and transport clip.
Figure 4:
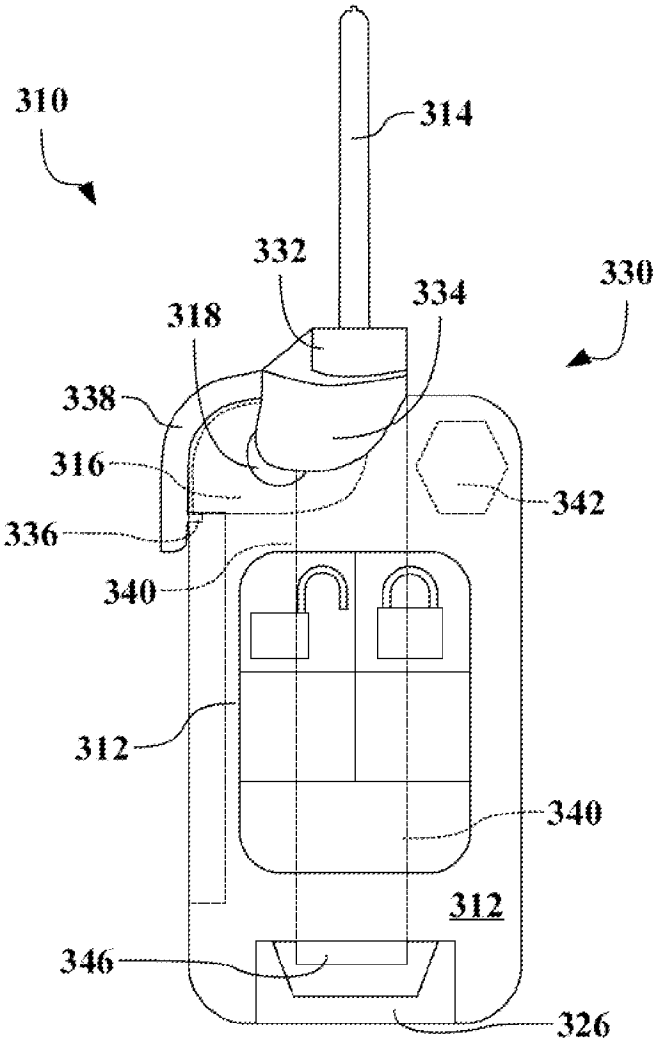
FIG. 4 is a schematic, plan view of another key fob and transport clip.

Referring now to FIG. 3 and FIG. 4, and with continued reference to FIGS. 1A, 1B, and 2, there are shown additional key fobs and transport clips. FIG. 3 shows an plan view of a key fob 210, and FIG. 4 shows an plan view of a key fob 310.

The key fob 210 and the key fob 310 are similar to the key fob 10 shown in FIGS. 1A and 1B and the key fob 110 shown in FIG. 2. The description of FIGS. 1A, 1B, and 2 may be used to supplement the description of FIGS. 3 and 4 and to identify any unnumbered items. Features and components shown in other figures may be incorporated and used with those shown in FIG. 3 and FIG. 4, and all elements may be mixed and matched between any of the configurations shown.

The key fob 210 shown in FIG. 3 has a transport clip 230 attached thereto. The transport clip 230 has a neck 232 surrounding a key blade 214 of the key fob 210. An ear potion 234 extends over a latch button 218 and depresses the latch button 218, such that the key blade 214 is free to rotate relative to a fob body 212, and may pivot about a lockable bearing 216.

A snap feature 236 is attached to an arm 238 extending to the left (as viewed in FIG. 3) of the neck 232. The snap feature 236 may attach to the lockable bearing 216. A breakable tab 240 extends to the right (as viewed in FIG. 3) of the neck 232. The breakable tab 240 then extends around the back of the key fob 210 and attaches or clips to the opposing side of the fob body 212. The hidden portion of the breakable tab 240 is shown in dashed lines.

Some versions of the key fob 210 may include a transceiver module 242 disposed within the fob body 212. The transceiver module 242 may include a receiver, a transponder, or any combination thereof. In some configurations of the key fob 110, the transceiver module 242 may need to be kept in close proximity to the ignition switch, the steering column, or the door lock mechanism for some operations to take place. Therefore, the breakable tab 240 limits the likelihood of rotating the fob body 212 and moving the transceiver module 242 away from the ignition switch while the key blade 214 is engaged therewith.

As shown in FIG. 3, the transport clip 230 also includes a molded icon 244. The molded icon 244 may indicate removability of the transport clip 230 from the key fob 210. In many configurations of the key fob 210 and the transport clip 230, an end-user—such as a purchaser of the vehicle or a retailer of the vehicle—will remove the transport clip 230 from the key fob 210 following completion of assembly and transportation of the key fob 210 and the vehicle.

A grip element 246 is formed on the end of the breakable tab 240 and may assist in holding the breakable tab 240 to the fob body 212. When torque is applied to the key blade 214 that would cause the key blade 214 to rotate counterclockwise, the breakable tab 240 is placed in tension and reacts against rotation of the key blade 214 relative to the fob body 212.

The breakable tab 240, the grip element 246, or a combination of both may be configured to yield under a torque load that is less than the holding load when the latch button 218 is locked. Therefore, the breakable tab 240 will allow rotation of the key blade 214 under loads which the lockable bearing 216 would not, and the breakable tab 240 may yield under loads which may otherwise damage the key blade 214.

The key fob 310 shown in FIG. 4 has a transport clip 330 attached thereto. The transport clip 330 has a neck 332 surrounding a key blade 314 of the key fob 310. An ear potion 334 extends over a latch button 318 and depresses the latch button 318, such that the latch button 318 does not prevent the key blade 314 from rotating relative to a fob body 312. A snap feature 336 is attached to an arm 338 extending to the left (as viewed in FIG. 4) of the neck 332. The snap feature 336 may attach to a lockable bearing 316.

A breakable tab 340 extends from the neck 332 down the back (relative to the view of FIG. 4). The breakable tab 340 extends around the back of the key fob 310 and attaches or clips to the bottom of the fob body 312. The hidden portion of the breakable tab 340 is shown in dashed lines. Some versions of the key fob 310 may include a transceiver module 342 disposed within the fob body 312. The transceiver module 342 may include a receiver, a transponder, or any combination thereof.

One or more grip elements 346 are formed on the end of the breakable tab 340 and may assist in holding the breakable tab 340 to the fob body 312. The grip elements 346 attach to, or attach adjacent to, an attachment point 326. Alternatively, the grip elements 346 may attach to the bottom of the fob body 312. When torque is applied to the key blade 314, the breakable tab 340 provides reaction torque and limits rotation of the key blade 314 relative to the fob body 312.

The breakable tab 340, the grip elements 346, or combinations thereof may be configured to yield under force resulting in a torque load that is less than the holding load when the latch button 318 is locked. Therefore, the breakable tab 340 will allow rotation of the key blade 314 under loads that the lockable bearing would not, and the breakable tab 340 may yield under loads which may otherwise damage the key blade 314.

Although not shown, a similar configuration of the transport clip 330 may have the breakable tab 340 extending to the right (as viewed in FIG. 4) and wrapping around the side of the fob body 312 to the attachment point 326. The grip elements 346 would then grasp the right side (as view in FIG. 4) of the attachment point 326. In such a configuration, counterclockwise torque on the key blade 314 would cause the breakable tab 340 to pull the grip elements 346 against the right side of the attachment point 326 and provide reaction torque to hold the key blade 314 in the deployed position, unless the torque is sufficient to yield the breakable tab 340.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A transport clip for attachment to a key fob having a fob body and a key blade, wherein the key blade is selectively rotatable between a stowed position in which the key blade is substantially within the fob body and a deployed position in which the key blade extends away from the fob body, the transport clip comprising:

a neck configured for at least partially surrounding the key blade and configured to be operatively attached to the key blade, such that the neck prevents rotation of the transport clip relative to the key blade; and an ear portion extending from the neck and configured to depress a latch button of the key fob to an unlocked position, wherein the unlocked position of the latch button allows substantially free rotation of the key blade between the deployed position and the stowed position.

2. The transport clip of claim 1, further comprising:

a breakable tab configured to prevent rotation of the transport clip relative to the fob body, such that rotation of the key blade from the deployed position to the stowed position is limited.

3. The transport clip of claim 2, further comprising:

wherein a locked position of the latch button prevents rotation of the key blade when in the stowed position and the deployed position;

wherein the locked position of the latch button subjects the key blade to a first torque relative to the fob body while in the deployed position; and wherein the breakable tab is configured to yield and allow rotation of the key blade away from the deployed position when the key blade is subjected to a second torque relative to the fob body, wherein the second torque is less than the first torque.

4. The transport clip of claim 3, wherein the key fob further includes a lockable bearing that attaches the key blade to the fob body, and further comprising:

a snap feature configured to attach the transport clip to the lockable bearing.

5. The transport clip of claim 4, wherein the transport clip is formed from a single material as a unitary body having one-piece construction.

6. The transport clip of claim 5, wherein the single material is a plastic.

7. The transport clip of claim 6, further comprising:

a molded icon, wherein the molded icon indicates removability of the transport clip from the key fob.

8. The transport clip of claim 7, wherein the neck fully surrounds the key blade.

9. A key fob assembly comprising:

a key fob, including:

a fob body; and a key blade, wherein the key blade is selectively rotatable between a stowed position in which the key blade is substantially within the fob body and a deployed position in which the key blade extends away from the fob body; and a transport clip, including:

a neck surrounding the key blade and operatively attached to the key blade, such that the neck prevents rotation of the transport clip relative to the key blade; and an ear portion extending from the neck and configured to depress a latch button of the key fob to an unlocked position, wherein the unlocked position of the latch button allows substantially free rotation of the key blade between the deployed position and the stowed position.

10. The key fob assembly of claim 9, wherein the key fob further includes a lockable bearing that attaches the key blade to the fob body; and wherein the transport clip further includes a snap feature configured to attach the transport clip to the lockable bearing of the key fob.

11. The key fob assembly of claim 10, wherein the transport clip is formed from a single material as a unitary body having one-piece construction.

12. The key fob assembly of claim 11, wherein the single material of the transport clip is a plastic.

13. The key fob assembly of claim 12, wherein the transport clip further includes:

a breakable tab configured to prevent rotation of the transport clip relative to the fob body, such that rotation of the key blade from the deployed position to the stowed position is limited;

wherein a locked position of the latch button prevents rotation of the key blade when in the stowed position and the deployed position;

wherein the locked position of the latch button subjects the key blade to a first torque relative to the fob body while in the deployed position; and wherein the breakable tab is configured to yield and allow rotation of the key blade away from the deployed position when the key blade is subjected to a second torque relative to the fob body, wherein the second torque is less than the first torque.

14. A transport clip for attachment to a key fob having a fob body, a key blade, and a lockable bearing that attaches the key blade to the fob body, wherein the key blade is selectively rotatable between a stowed position in which the key blade is substantially within the fob body and a deployed position in which the key blade extends away from the fob body, the transport clip comprising:

a neck configured to surround the key blade and to be operatively attached to the key blade, such that the neck prevents rotation of the transport clip relative to the key blade;

an ear portion extending from the neck and configured to depress a latch button of the key fob to an unlocked position, wherein the unlocked position of the latch button allows substantially free rotation of the key blade between the deployed position and the stowed position;

a snap feature configured to attach the transport clip to the lockable bearing; and a breakable tab configured to prevent rotation of the transport clip relative to the fob body, such that rotation of the key blade from the deployed position to the stowed position is limited, wherein a locked position of the latch button prevents rotation of the key blade when in the stowed position and the deployed position, wherein the locked position of the latch button subjects the key blade to a first torque relative to the fob body while in the deployed position, and wherein the breakable tab is configured to yield and allow rotation of the key blade away from the deployed position when the key blade is subjected to a second torque relative to the fob body, wherein the second torque is less than the first torque.

* * * * *